US011676624B2

(12) United States Patent
Davis et al.

(10) Patent No.: US 11,676,624 B2
(45) **Date of Patent: *Jun. 13, 2023**

(54) MINIMIZING GUNSHOT DETECTION FALSE POSITIVES

(71) Applicant: UTILITY ASSOCIATES, INC., Decatur, GA (US)

(72) Inventors: Ted Michael Davis, Decatur, GA (US); Eric H Bedell, Marietta, GA (US); Robert S McKeeman, Atlanta, GA (US)

(73) Assignee: UTILITY ASSOCIATES, INC., Decatur, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/474,819

(22) Filed: Sep. 14, 2021

(65) Prior Publication Data

US 2022/0199106 A1 Jun. 23, 2022

Related U.S. Application Data

(63) Continuation of application No. 16/886,421, filed on May 28, 2020, now Pat. No. 11,133,021.
(Continued)

(51) Int. Cl.
*G10L 25/51* (2013.01)
*G10L 19/02* (2013.01)
(Continued)

(52) U.S. Cl.
CPC ..... *G10L 25/51* (2013.01); *G10L 19/02* (2013.01); *G10L 25/06* (2013.01); *G10L 25/18* (2013.01); *G10L 25/24* (2013.01); *F41H 11/00* (2013.01)

(58) Field of Classification Search
CPC ..... G10L 25/51; G10L 19/02; G10L 25/06; G10L 25/18; G10L 25/24; G10L 15/02; G10L 15/22; G10L 25/66; G10L 25/78; F41H 11/00; F41A 19/01; G06K 9/00288; G06K 9/00805; G06K 2009/00738;
(Continued)

(56) References Cited

U.S. PATENT DOCUMENTS 2,009,013 A 7/1935 Karplus
4,622,554 A * 11/1986 Gellekink ..... G01S 13/68 342/67
(Continued)

FOREIGN PATENT DOCUMENTS

CN 107862279 3/2018
EP 3006908 4/2016
(Continued)

OTHER PUBLICATIONS

First Action Interview issued for U.S. Appl. No. 17/198,568, dated May 26, 2021.
(Continued)

*Primary Examiner* — Akelaw Teshale
(74) *Attorney, Agent, or Firm* — Meunier Carlin & Curfman LLC

(57) ABSTRACT

This invention is a gunshot detection device that provides very reliable inside and outside real-time situational awareness of gunshot events, while reducing Gunshot Detection False Positives and Negatives.

20 Claims, 4 Drawing Sheets

Related U.S. Application Data

(60) Provisional application No. 62/853,437, filed on May 28, 2019.

(51) Int. Cl.
*G10L 25/06* (2013.01)
*G10L 25/18* (2013.01)
*G10L 25/24* (2013.01)
*F41H 11/00* (2006.01)

(58) Field of Classification Search
CPC ..... G06K 9/00536; G08B 13/1672; G08B 21/02; G08B 25/016
See application file for complete search history.

(56) References Cited

U.S. PATENT DOCUMENTS 5,504,717 A * 4/1996 Sharkey ..... G01S 3/801 367/129
5,917,775 A * 6/1999 Salisbury ..... G01H 3/12 340/552
5,973,998 A * 10/1999 Showen ..... G01S 5/0036 367/129
6,167,192 A 12/2000 Heo
6,356,872 B1 3/2002 Leung
6,847,587 B2 * 1/2005 Patterson ..... G01V 1/001 367/906
7,003,358 B2 2/2006 Eastty
7,577,259 B2 8/2009 Iwata
7,961,550 B2 * 6/2011 Calhoun ..... G01S 5/18 367/127
8,199,923 B2 6/2012 Christoph
8,730,040 B2 * 5/2014 Donovan ..... G08B 13/19693 340/521
8,918,343 B2 * 12/2014 Mitchell ..... G10L 21/0216 706/12
9,111,047 B1 8/2015 Shridhar
9,830,932 B1 * 11/2017 Gunderson ..... G08B 5/22
9,883,046 B1 * 1/2018 LaBosco ..... H04L 25/0278
9,943,174 B1 * 4/2018 Jacobs ..... A61H 9/0078
10,089,845 B2 10/2018 Skorpik
10,115,410 B2 10/2018 Craven
10,627,292 B1 * 4/2020 Fowler ..... H04R 29/00
10,763,828 B2 9/2020 Craven
10,810,854 B1 * 10/2020 Correnti ..... G08B 1/08
2008/0168895 A1 * 7/2008 Duong ..... F42B 12/54 89/1.1
2009/0135007 A1 * 5/2009 Donovan ..... H04N 7/181 340/500
2010/0246328 A1 * 9/2010 Gudgel ..... G01S 5/06 367/127
2011/0218952 A1 * 9/2011 Mitchell ..... G10L 21/0216 706/12
2012/0300587 A1 * 11/2012 Azimi-Sadjadi ..... G01S 5/30 367/127
2014/0269199 A1 * 9/2014 Weldon ..... G01S 5/30 367/124
2014/0306818 A1 * 10/2014 Batchelder ..... G08B 15/02 340/501
2014/0327543 A1 * 11/2014 Showen ..... G01S 5/18 340/540
2014/0361886 A1 * 12/2014 Cowdry ..... G08B 13/1672 340/522
2015/0081579 A1 * 3/2015 Brown ..... H04W 4/02 705/325
2015/0194045 A1 * 7/2015 Edwards ..... G08B 13/1672 340/540
2016/0042767 A1 * 2/2016 Araya ..... H04N 7/188 386/201
2016/0086481 A1 * 3/2016 McNutt ..... G08B 7/06 340/540
2016/0133107 A1 * 5/2016 Showen ..... G08B 29/183 340/540
2016/0157032 A1 * 6/2016 Kane ..... G08B 29/185 381/56
2016/0163168 A1 * 6/2016 Brav ..... G08B 29/188 381/56
2016/0191163 A1 * 6/2016 Preston ..... G01B 11/161 398/16
2016/0232774 A1 * 8/2016 Noland ..... G08B 25/10
2016/0260307 A1 * 9/2016 Skorpik ..... G08B 21/02
2017/0069190 A1 * 3/2017 Hansen ..... G06V 40/172
2017/0110141 A1 4/2017 Craven
2017/0123038 A1 * 5/2017 Griggs ..... G08B 29/188
2017/0154521 A1 * 6/2017 Zamorano-Larrate ..... G08B 21/043
2017/0169686 A1 * 6/2017 Skorpik ..... G08B 29/185
2017/0323540 A1 * 11/2017 Boykin ..... H04N 1/00
2017/0374192 A1 * 12/2017 Gersten ..... H04N 5/772
2018/0053394 A1 * 2/2018 Gersten ..... H04N 9/8205
2018/0159473 A1 6/2018 Nestler
2018/0293858 A1 * 10/2018 Carter ..... G08B 21/02
2019/0019380 A1 * 1/2019 Williams ..... G08B 19/00
2019/0080577 A1 * 3/2019 Raz ..... G01H 3/10
2019/0122534 A1 * 4/2019 McNutt ..... G08B 7/06
2019/0180606 A1 * 6/2019 Pirkle ..... G08B 13/1672
2019/0186875 A1 * 6/2019 Pirkle ..... F41J 5/06
2019/0212186 A1 * 7/2019 Warren ..... H04R 29/00
2019/0222756 A1 * 7/2019 Moloney ..... G06V 40/166
2019/0259378 A1 * 8/2019 Khadloya ..... G06N 20/10
2019/0311604 A1 * 10/2019 Morehouse ..... G08B 13/19613
2019/0318596 A1 * 10/2019 Pacella ..... G05D 1/0027
2019/0347920 A1 * 11/2019 Anderson ..... G08B 13/1672
2019/0371160 A1 * 12/2019 Pace ..... G08B 13/19608
2020/0020215 A1 * 1/2020 Pirkle ..... G08B 25/14
2020/0037142 A1 * 1/2020 Lofton ..... G08B 13/1672
2020/0051189 A1 * 2/2020 Williams ..... H04L 67/535
2020/0066126 A1 * 2/2020 Voor ..... G08B 17/08
2020/0088832 A1 * 3/2020 Jarrett ..... G01S 5/20
2020/0143823 A1 * 5/2020 Ahlberg ..... G10L 25/18
2020/0211361 A1 * 7/2020 McSchooler ..... G08B 25/14
2020/0234554 A1 * 7/2020 Rehfeld ..... G08B 29/188
2020/0278239 A1 * 9/2020 Jax ..... G08B 13/1672
2020/0381006 A1 * 12/2020 Davis ..... G10L 25/24
2020/0402378 A1 * 12/2020 Connell, II ..... G08B 19/00
2021/0020023 A1 * 1/2021 Pirkle ..... H04R 3/005

FOREIGN PATENT DOCUMENTS

WO WO-2019246635 A2 * 12/2019 ..... F41H 11/00
WO WO-2020256906 A1 * 12/2020 ..... G08B 13/1672

OTHER PUBLICATIONS

Non-Final Office Action issued for U.S. Appl. No. 17/198,568, dated Jun. 8, 2021.
Prince, et al., Deploying Acoustic Detection Algorithms on Low-Cost, Open-Source Acoustic Sensors for Environmental Monitoring (Year 2019).
International Search Report and Written Opinion issued for Application No. PCT/US2020/035011, dated Nov. 13, 2020.
Notice of Allowance issued for U.S. Appl. No. 17/198,568, dated Feb. 1, 2022.
Interview Summary issued for U.S. Appl. No. 17/198,568, dated Dec. 21, 2021.

* cited by examiner

MINIMIZING GUNSHOT DETECTION FALSE POSITIVES

CROSS-REFERENCE TO RELATED APPLICATIONS

This application is a continuation of U.S. application Ser. No. 16/886,421, filed May 28, 2020, which claims priority to U.S. Provisional Application No. 62/853,437, filed May 28, 2019, the contents of which are expressly incorporated herein by reference in its entirety.

STATEMENT REGARDING FEDERALLY SPONSORED RESEARCH OR DEVELOPMENT

Not Applicable

REFERENCE TO SEQUENCE LISTING, A TABLE, OR A COMPUTER PROGRAM LISTING COMPACT DISK APPENDIX

Not Applicable

BACKGROUND OF THE INVENTION

The present invention generally relates to a system that reliably and autonomously classifies the sound of a gunshot and minimizes gunshot detection false positives and false negatives. In this gunshot sound context, a gunshot detection false positive is an event that was identified as being a gunshot, but was not actually a gunshot. A gunshot detection false negative is an event where a gunshot actually did occur, but the gunshot event was not detected.

"Shots Fired" reports in urban areas, schools, churches, offices, and businesses often trigger a significant Law Enforcement and First Responder response. Nearby First Responders often drop whatever they are doing to rush to the scene. Perimeter cordons are set up around schools, hospitals, offices, and residential areas. The area is usually locked down and evacuated. Normal community activities—schools, shopping malls, businesses, offices, residential areas, churches, and street traffic—stop for extended periods of time while the reported gunshot is investigated. Overall there is a significant disruption of normal community activity. A high rate of gunshot false positives can cause First Responder resources to triage or ignore some or all gunshot detection alerts unless there is a corroborating event. In the case of an actual gunshot, response delays have negative results to life and property. For these reasons, eliminating gunshot false positives and improving the timeliness of correct classification is very important to the community seeking such an alerting system.

Police Officers responding to a gunshot detection alert, especially in the heat of making split-second decisions with incomplete and imperfect information, risk mistakenly identifying an innocent bystander as a possible shooter; "friendly fire" mistakes are seemingly inevitable. Similarly, citizens in the vicinity of a possible gunshot event, particularly at night, may not be able to distinguish between First Responders and home invaders, drug dealers, gang members, or other assailants. As a result, such citizen or citizens may fire a weapon at First Responders in a good faith belief they are defending life and property or acting in self-defense. A false positive gunshot detection event could inadvertently turn into a "friendly fire" situation with tragic results for all involved.

Gunshot false positive detection reports may also cause so-called "Red Flag" events, where Police may believe that gunshots have repeatedly occurred at a location. In some states, a Red Flag alert warrants and/or authorizes seizing weapons from persons who are claimed on some basis, including unlawful weapons discharge, to be a threat to the community. Red Flag SWAT team assaults with no advance notice have been and may be launched into homes or businesses where law-abiding citizens with a legal right to possess a firearm work or reside. A citizen and/or a First Responder may inadvertently get killed or injured if First Responders do not identify themselves adequately, or if the citizen is deaf or does not speak English, or there is some other communications breakdown factor. For example, a Citizen might believe a Red Flag assault team is not the Police, but instead, a hostile or criminal invaders who is falsely claiming to be a police officer. In such a circumstance, the citizen might initiate or return fire in a good faith but mistaken case of identity. Red Flag street address mistakes have been made. Life or death decisions are made quickly and events happen with split-second timing. Risks to both First Responders and citizens are exacerbated if a high number of gunshot false positives are reported in an area.

Given the history of mass shooting events, almost any gunshot detection response is likely to increase the public's overall anxiety level. A full Police response to a gunshot false positive event will likely cause fear, uncertainty, and doubt amongst the public, including school children, teachers, parents, office workers, worshippers, shoppers, residents, visitors, et al, even if there is no actual gunshot event or shooter. Education classes and religious services are frequently interrupted; commerce is curtailed; parents pull children from school, adding to the general chaos of an event. Businesses suffer loss of revenue if people leave an area, or become nervous and reluctant to visit a store, office, bank, restaurant, gym, and other commercial location. Overall citizen confidence in Public Safety can decline if gunshot events are falsely reported.

Similarly, a high level of "false alarms" can cause a cumulative increase in public distrust and skepticism about gunshot detection technology overall. Like false positive fire and smoke alarm alerts, and/or car horn panic button alerts, a high rate of "false positives" will cause future gunshot alerts to be more likely to be ignored. One or two "Cry Wolf" experiences might cause delays in First Responders reacting to future actual gunshot incidents, and/or cause inadequate resources to initially be dispatched to actual gunshot events, while time is spent trying to determine if there really is an actual gunshot.

A high level of "false positive" gunshot alerts will likely cast doubt in the mind of citizens, police officers, and political leaders about the overall reliability of gunshot detection technology. There can be a negative perception for Police technology and training in general, and ultimately overall First Responder competence. For such public confidence and other reasons, gunshot detection technology is preferably highly accurate, with minimal gunshot false positives.

Prior art gunshot detection efforts are seen in U.S. Pat. No. 5,917,775 (Salisbury) patent and U.S. Pat. No. 10,089,845 (Skorpik). Generally speaking, these references disclose using acoustic energy as a basis for deciding if a sound event is a gunshot. The Salisbury '775 Patent uses a Piezo Electric Microphone to capture sound energy level which is converted to digitized binary codes. The binary codes are compared with certain gunshot detection criteria to determine if a gunshot has been detected. The Skorpik '845 Patent is focused only on gunshot recognition in confined spaces, and uses band pass filtering to isolate the sound energy level within a narrow frequency band. In these and other such instances, a gunshot determination is made solely on exceeding certain discretely measured values, a one-dimensional pre-set total energy value. In both of the Salisbury and Skorpik patents, any captured sound that exceeds a pre-defined acoustic energy value threshold is considered to be a gunshot. However, other sound generating events that are not gunshots will also generate waveforms and energy levels similar to a gunshot, particularly within the human frequency hearing range of 20 Hz to 20 kHz. Such references, even to the extent that a device according to either reference is able to detect a gunshot event, disclose a methodology that also undesirably promotes reporting gunshot false positives.

Yet other prior art gunshot detection efforts are seen U.S. Pat. No. 6,847,587 (Patterson) and U.S. Pat. No. 7,961,550 (Calhoun). Generally speaking, these references are directed to a network of audio microphones to recognize the location of acoustic events, including gunshots. They are not seeking to reliably determine a gunshot, or acknowledge, decrease, or eliminate gunshot false positives or false negatives, capabilities taught by the current invention.

The Patterson '587 reference generally discloses a "known acoustic event" that is identified by receiving acoustic waves at a sensor, and then compares those waves to a stored envelope and spectral characteristics of an acoustic event (gunshot). If there is a minimum pre-determined correlation (of sound envelope points and spectral characteristics), then the "acoustic event" location is estimated based upon triangulation between microphones. Many sounds that are not gunshots will have a high correlation using this methodology.

The Calhoun '550 reference generally describes a system and method to segregate data from different gunshot events that are in close time proximity. More particularly, the Calhoun '550 reference focuses on transforming gunshot sound data into time pulse subsets, and matching the time pulse subsets to known gunshot time pulse subsets. There is processing that purports to distinguish between multiple gunshots in close time proximity, where long distance and echoes off hard surfaces and the relatively slow speed of sound can result in the sound pulse subsets to overlap each other. For example, some portion of a sound from gunshot 1 may arrive at a distant microphone after a sound from gunshot 2 arrives at the microphone. The Calhoun '550 patent generally describes a system and method to segregate data from different gunshot events that are in close time proximity. Once again, this reference does not address the inherent limitations of such a system to overcome the gunshot false positives and false negatives that will occur given similar sounds within the time domain. In both of the Patterson '587 and Calhoun '550 patents, the primary teaching is on a triangulating methodology and related disclosures for determining the physical location of a gunshot-like sound. As before, even to the extent that a device according to either reference is able to identify an actual gunshot, another sound event that generates a sound decibel level and waveform similar to a gunshot will correlate and subsequently result in generating the location of a gunshot false positive.

While these prior art references purport to be sound-based gunshot detection systems, in truth any short-duration sound containing high-energy content that spans the frequencies from 20 Hz to 20 KHz, the human hearing range, may be misclassified as a gunshot by such prior art acoustic-based systems. And because responding to a gunshot detection alert has a very high social and monetary cost, the market is ripe for a solution that is reliable, inexpensive, and autonomous.

The challenge is and has been identifying true gunshots out of a range of events that generate similar short-duration, high-energy audio wave patterns. Currently, there are no highly reliable systems on the market that can autonomously and accurately meet this challenge by only using acoustic information. Programmatic solutions that have sought to do so are often confused by short-duration, high-energy audio wave patterns and therefore both gunshot false positives and false negatives are the result. In an effort to improve results, human analysis was introduced into an otherwise autonomous ecosystem. While this effort has been shown to improve the reliability over artificial intelligence (AI) or algometric methodologies alone, the resulting 85% reliability rate is still far from desirable. This human escalation step significantly increases the cost and necessarily adds unwanted delay to the time required for proper classification. Also, the resulting reliability becomes variable due to the reviewer's limitations—their innate hearing ability, and their experience may significantly impact whether a response is justified or not and this threatens the viability of the entire system if their assessment is wrong. It is therefore desirable to have a more reliable autonomous system that would achieve the same or better results without the reliance on the human factor given its unavoidable variability and higher fixed costs.

Systems that have had limited commercial success, like ShotSpotter™, come with a high price tag and are not autonomous as they ultimately depend upon a person's judgement as the final arbiter. The addition of the human screening was done to improve the system's overall reliability—allowing for the market to accept, purchase, deploy, and continue to use such a system. In an effort to achieve competitive results within confined spaces, other systems have sought to augment the sound-based approach with the addition of other sensors. Examples include light sensors that seek to detect the muzzle flash associated with a gunshot, and then using the confluence of sensor information to increase classification accuracy. While this is an improvement, it also compounds the requirements; the muzzle flash must be observed in order to correlate the events and obviously many factors may cause this confluence to fail.

Artificial Intelligence (AI) has also been tasked with the classification of acoustic events. The reliability of any AI-based system to properly classify acoustic samples is limited by the quantity and quality of its training set and how it was implemented. The current invention asserts that AI classification methods currently yield gunshot false positives and false negatives, largely because of poor-quality training sets derived from the flawed sampling methods used by prior art systems—garbage in garbage out (GIGO).

An over reliance upon the research of others is believed to have led to the current acceptance of the status quo. As an example, a frequency plot of a gunshot sound published in a Physics Forum article incorrectly shows a linear decay to background energy levels as the frequency plot approaches 20 kHz. The Physics Forum analysis asserts there is no gunshot sound energy within the ultrasound range, specifically above 20 kHz. This is due to the fact that they used equipment that attenuated, filtered out, and through digital conversion ultimately lost the higher frequency data content of a true gunshot.

Many whitepapers including IEEE technical articles have focused on the classification of sounds including gunshots using only acoustic information. Notwithstanding all of the effort, conclusions drawn by these efforts pertaining to gunshots are profoundly flawed. These studies disclosed using off-the-shelf sound equipment including studio acoustic microphones, frequency filters, amplifiers, and audio recorders to capture sounds. Comparing the data from the current invention to that being published, the filters used by researchers have caused signal attenuation within certain frequencies and because of the slow sampling rates, ultrasonic information is being lost from the resulting digital signal during the analog-to-digital conversion step. Unfortunately, the unique information that is so relevant and necessary for the proper classification of gunshots was obscured by the equipment and methodology of the researchers. In effect, these in-depth studies are undermined by their ill-suited methodologies. Over time the same type experiments yielded the same results, and ultimately the results and studies were published. It would be counterintuitive to assume such research was wrong, but it was fundamentally flawed. As a result, at least with respect to gunshot recognition, the purported facts being circulated have actually stymied progress and invention.

The current invention teaches and discloses that the tell-tale acoustic signature of a gunshot hides within the ultrasonic spectrum; it is characterized as a very short-duration, high-energy, wide-spectrum burst that cannot be heard by the human ear. This discovery has not been taught by any prior art invention. Accurately detecting such a burst of sound as a gunshot requires advanced analytics and equipment capable of sampling, storing, and processing sound data at sampling rates and frequencies not supported by most digital recording equipment including smartphones. The information contained within the ultrasonic burst is critical for the proper detection and classification of gunshots and the current invention and its various embodiments are the first to teach and take full advantage of a gunshot's ultrasonic idiosyncrasies and in doing so provide performance levels far superior to prior art alternatives.

SUMMARY OF THE INVENTION

The disclosed invention provides a system and method by which to detect and analyze a gunshot event in a highly reliable manner so as to reduce and/or minimize instances of gunshot false positives and gunshot false negatives.

The current invention teaches and discloses that the tell-tale acoustic signature of a true gunshot resides within its acoustic waveform, specifically within its ultrasonic components, and is characterized by a fleeting high-energy, wide-spectrum burst that cannot be heard by humans. Detecting such a burst requires advanced analytics and equipment capable of sampling, processing, and storing sound including human audible and ultrasonic frequency ranges. The required hardware and programmatic access to the resulting signals is beyond the capabilities of most digital audio recording equipment including smartphones.

The information contained within the ultrasonic burst allows for the proper detection and classification of gunshots. The current invention and its various embodiments are the first to teach and take full advantage of a gunshot's ultrasonic idiosyncrasies and in doing so provide gunshot recognition performance levels far superior to prior art alternatives.

With regard to sampling, we refer to how the sound data is collected in the first place. The microphone used must have the ability to reproduce the frequency content of the waveform. In specific application, a true gunshot produces a highly complex analog waveform having components that range from 20 hz to well above 20 kHz, reaching high into the ultrasonic spectrum. In order to not lose the high-frequency content of the analog waveform, it is preferable that the analog-to-digital conversion (ADC), according to the Nyquist Theorem, provide a sampling rate of at least twice that of the component frequency sought to be capture digitally. And ideally this sampling rate should be twice $f_{max}$, the highest frequency component measured in hertz for a given analog signal. When sampling is less than $2f_{max}$, the highest frequency components of the gunshot are lost. A gunshot is a highly complex waveform having a short duration and to faithfully reproduce its initial ultrasonic burst requires a very high sampling rate. Given the bandwidth requirements, an ADC capable of approximately 300 kHz should be used. To put this sampling rate in proper perspective, typical sampling rates of consumer quality acoustic systems are set to 44.1 kHz, often referred to as CD quality sound, since audio compact discs use the 4.1 kHz sampling rate.

Sampling also pertains to how our library of representative data is collected for use in AI and multiple embodiments of the current invention. Classification is further improved by leveraging the fact that a gunshot's sound varies based upon angle from the shooter and other known factors. Creating a library and subsequently utilizing AI training set of sounds requires capturing thousands of discrete samples while varying the common acoustic variables associated with a gunshot's sound. For efficiency's sake, recording stations set at various angles and distances obtain samples from a plethora of ammunition and weaponry. Each sample collected has its associated metadata recoded including: distance, angle, caliber, barrel length and any other information deemed advisable for reliably determining a gunshot.

The resulting library of sounds may be further processed to obtain templates in the form of Spectrograms, where a typical representation for each combination is obtained. Spectrograms provide time, frequency, and intensity information and can be represented as images where each pixel of the resulting spectrogram image represents the time, frequency, and intensity of the signal. Spectrograms contain the data that is conducive to both correlation and AI classification methods. Regardless of the methodology used by a particular embodiment of the current invention, the present invention preferably contemplates that the aforementioned ultrasonic burst is included within the dataset for the classification step to yield an accurate result. Prior art systems do not capture this information, so they cannot leverage the information contained therein.

With regard to processing, there are actually many processing requirements and steps. In real-time a multi-level gating analysis process is continuously run against the digital sample to determine if a possible gunshot warrants advanced processing. Initially, "the net is cast widely" by performing, for example, a continuous high-level audio analysis looking for an impulse. It's not important to be discriminating at this stage. This step promotes signal processing efficiency, allowing for the reduction of unwarranted advanced and more costly processing. If the result of this first stage yields a candidate, the system applies a second stage, which includes analysis of an audio waveform Spectrogram that includes ultrasonic frequency data. The frequency information of the Spectrogram may be determined in a number of ways, including amongst others, utilizing a Fast Fourier Transformation analysis. This process essentially corresponds to computing the magnitude of the short-time Fourier transforms (STFT) of the signal. By calculating the frequency components of the signal over slices of time separate pieces are calculated and these windows may overlap in time and may be assembled or transformed.

With regard to storage, it is important to store the raw sampling of audio data for gunshot and for non-gunshot audio events during the collection phase. Those data are then compiled into a library that edge devices can quickly use to make fast and efficient gunshot/non-gunshot decisions, using the gating, correlation, and machine learning methods mentioned above. Additionally, edge devices store and forward to a central repository raw samples of potential gunshot audio events. The central repository is then used to further refine the processing library and algorithm to further enhance the overall system and methodology.

There could be several gunshot recognition algorithm embodiments depending upon the connectivity, processing power, and storage capacity available on the gunshot detection device, and whether recognition is performed by the gunshot detection device as a local edge processor, or by sending raw audio waveform data to a remote processor and storage for analysis and recognition feedback. Recognition algorithm embodiments could include simpler or more complex Spectrogram Image Signature Pattern Analysis and Correlation, Spectrogram Pixel Array Histogram Correlation, Spectrogram AI Model Edge Processing, other methods, or combinations thereof depending upon engineering tradeoffs of processing power, microphone frequency recognition and sampling capability, storage capacity, response time performance, real-time connectivity, security, device dimensions, battery life, durability, and cost. For lower cost embodiments the system and method can utilize correlation against a calculated Spectrogram and a representative sample. For the AI Model edge processing embodiment, the training process can be automated by having all of the metadata correct the classification "on the fly" in near real-time. Another embodiment would be to perform both Spectrogram representative sample correlation and AI Model edge processing, and use policy-based rules to make a gunshot recognition decision when two or more systems and methods agree or disagree.

Our methodology and circuitry does not use bandpass filters. Instead, our system and method uses ADC and math processing. Our preferred embodiment does not require the use of bandpass filters to distinguish between events (e.g., gunshot vs. not a gunshot).

An embodiment of the present invention may also be able to transmit gunshot detection events as real-time situational alerts, including over wireless communications such as 4G-LTE, BlueTooth, WiFi, 900 Mhz, and other wireless connectivity. Such transmissions could be sent to Police officers, Corrections staff, security guards, First Responders and/or associated vehicles, churches, synagogues, schools, shopping malls, restaurants, retail stores, sports stadiums, smart cities and their associated devices. Ultimately, 911 Dispatch Centers, local video integration centers, Federal, State, and Regional emergency monitoring and alert centers; fire stations; emergency medical response centers; hospitals; national and local vendor security monitoring services; cloud and local server artificial intelligence-based security monitoring and management systems; centrally-monitored industrial, commercial, and/or residential video and security monitoring centers; standalone un-monitored home security systems; and any number of other mobile security data gathering and management solutions, will have near real-time access to the resulting metadata produced by the invention.

There may also be areas where a user would not want a gunshot detection device to record or report a gunshot. One example is a Police department may not want a gunshot detector, recording or other device to report a gunshot detection event from within a police gun practice range. And similarly, an entity may only want gunshot detection to operate within a specified time period, such as a designated date, day of week, and time range or an enterprise may want users to have the option to place gunshot detection into a manually selected "Off-Duty" mode that would ignore all possible gunshot events. This could be useful for police training at gun ranges, where there is typically a high level of gunshot activity that should not generate a gunshot detection emergency alert. Thus, a preferred embodiment would accommodate such policy-based requests.

It could also be useful for possible gunshot detection events to be used to automatically activate a camera or another gunshot detection device, and broadcast an alert and/or a live audio stream to a local or remote monitoring system, or to other Bluetooth or WiFi locally connected devices. A person wearing or carrying a gunshot detection device would preferably be able to send, but nonetheless may be unable to send (or be unwilling to further excite an active shooter) a "Shots Fired" alert. A silent alert or a live audio stream could allow local other First Responders and/or Law Enforcement, Command Staff to get an early notification of a possible active shooter situation, as they could listen to a live audio stream as an additional data source to determine if there is an active shooter situation, or a gunshot detection "false positive" event.

Moreover, the identity of a person utilizing a gunshot detection device could be identified on an electronic map, such as Teacher X is assigned to Classroom 1. This information could also provide real-time situational awareness of the location of the active shooter. Similarly, a preferred gunshot detection device could be provided with GPS or other location reporting capability to provide real-time situational awareness of the location of device and possible a nearby gunshot or active shooter event. In a like manner, a preferred gunshot detection device could include an emergency alert or "Panic Button" capability. One could manually send a "weapon situation" alert before any shots were fired (or knife, ax, sword, bomb, etc. were used as the weapon). The gunshot detection device could broadcast a loud siren or emergency alert sound. A preferred gunshot detection may also be able to take and upload photographs, and/or start live audio and/or video streaming to a local and/or central monitoring system to provide a real-time situational awareness view of audio, visual, and location metadata in a location where a gunshot was identified.

A preferred gunshot detection device could further serve as an individual component or combination microphone and edge processor, and as such may be able to locally identify gunshot events, and screen out gunshot false positives. It would be advantageous for nearby gunshot detection devices to communicate with each other, and on a "Crowdsource" basis further confirm that a gunshot event has occurred. Such confirmation could thus collectively improve classification. When seconds can mean the difference between life and death in an active-shooter situation, any time delay occasioned by transmitting a possible gunshot audio sound file to a third-party location, having the sound recording being placed into a review wait queue, and/or waiting some amount of time for a next available human analyst to listen to, classify, and report a possible gunshot event, should be avoided to the maximum extent possible. Data communications network bottlenecks and failures could prevent a possible gunshot sound file from ever getting transmitted to a remote third-party location where the file would be placed into a wait queue for centralized automated or human analysis. A gunshot detection system that is wide area network communications dependent, and/or requires remote human analysis or remote artificial intelligence engine or programmatic processing, could delay detection, and further delay an appropriate response (or even fail) when it was needed most.

Accordingly, there is a need for highly accurate gunshot detection that significantly improves upon the high rate of gunshot false positives and gunshot false negatives. The current invention in its various embodiments provide for such detection, enable better evidence gathering and, through its various communications and response capabilities, allows for meaningful response such that Police and other Emergency Services providers are able to respond more appropriately to the threat and with better situational awareness.

In one of its embodiments, inexpensive purpose-built acoustic hardware may be paired with devices that have certain computational capabilities, such as smartphones. The eventual incorporation of the current invention's circuitry and analytic methodology within current off-the-shelf devices is contemplated and expected by this filing. Thus, it is to be understood that the present invention may be used with or incorporated within mobile video and audio recording devices such as personal cameras, smartphones, broadcast media mobile news video cameras and audio recording devices, consumer-grade still and video cameras, audio recorders, and any other electronic mobile devices where an acoustic but proximity constrained gunshot detection alert capability might be desired.

Prior art attempts have been made to use smartphones to detect gunshots. However, in order for any platform to utilize or otherwise practice the disclosed invention, support for sound sampling rates sufficient to obtain the required requisite data are preferably implemented and exposed by the platform. In the alternative, an unmodified smartphone or similar computing platform may overcome innate limitations by having a secondary device paired with or directly connected to the platform that incorporates the invention's teaching.

FBI statistics between 1988 and 2003 show that 93% of the time, the distance between a shooter and a police officer killed by a gunshot occurred at distance of 50 feet or less. NYPD data from 1854 to 1979 shows that 90% of officers were killed within 15 feet from the shooter. For gunshot events between 1970 and 1979 where NYPD officers survived, the shooting distance in 75% of cases was less than 20 feet. Anecdotal reports from several recent school, church, and synagogue multiple gunshot events indicate they generally occurred after a gunman entered into a classroom, sanctuary, or hallway of relatively small dimensions. Long distance gunshot events are rare. It would thus be preferable that gunshot detection would be reliably determined within the historical distance range of many of gunshot events, which is 50 feet or less.

The present invention, in a preferred embodiment, is able to detect a gunshot, preferably at distances of as much as 200 meters. While the present invention has application at distances greater than 200 meters, it is most efficacious at distances of 200 meters or less due to the fact that ultrasonic energy decays rapidly and is largely undetectable for such purposes at distances over 200 meters from the source. Even so, as mentioned above, FBI and NYPD statistics show that many gunshot events occur at a distance of 50 feet or less. Gunshot detection utilizing data from at least a portion of the ultrasonic frequency range will be highly reliable within the historical distance range of the vast majority of gunshot events regardless of whether the gunshot event occurred in open space or within an enclosed space.

Devices constructed and methods practiced in accordance with the present invention could also be implemented as a standalone dedicated fixed location gunshot detection sensors, with or without wireless or wired connectivity, in all the locations and types of entities already identified. The present invention may further be applied in a wide variety of existing types of fixed location sensor and "internet of things" (IoT) technology devices such as wired or wireless security cameras, security systems, perimeter security light and motion sensors, doorbells, thermostats, aircraft and train controllers and sensors, fire, smoke, and carbon monoxide alarms, kitchen appliances, industrial machinery controllers, electric and gas meters, electric distribution and substation transformers, high voltage transmission line sensors, pipeline pumping station controllers, traffic lights, street lights, toll booths, other smart cities devices, gasoline pumps, retail point of sale systems, and any number of other mobile and fixed location devices where having a gunshot detection capability might be desired.

Devices and methods according to the present invention can also provide a highly reliable "crowdsourced" network ability to quickly identify and more precisely report the location of a gunshot event, without the delay of relying upon an imperfect human audio review, or rough triangulation between distant microphones.

A fixed or known device location of a device in accordance with the invention may be used to provide real-time situational awareness. For example, location information from device including an internal GPS sensor, or location information such as a known or assigned location such as Teacher A is assigned to Classroom 1, may be utilized to provide real-time situational awareness of approximately where in a school, office, or other facility one or more gunshots have occurred. The present invention further provides that gunshot detection sound waveform analysis can provide the approximate distance of a gunshot from a detection device. So, by reference to a fixed or known location, the approximate real-time location of an active shooter can be estimated with significant reliability in accordance with the invention.

Some personal cameras and other potential gunshot detection devices may be constructed in accordance with the present invention so as to have local communications capabilities. Examples of such capabilities include BlueTooth and WiFi real-time wireless communications. As a result, such devices could communicate in real-time. A gunshot false positive could be further identified (including confirmed or rejected as such) in accordance with the invention by real-time correlation and polling of other nearby detection devices. If multiple independent devices in local proximity also detect a gunshot, then the "crowdsourcing" hive of multiple positive gunshot event reports will increase the overall collective confidence level that a gunshot actually has been detected. Conversely, if one gunshot detection device according to the invention concludes that a gunshot was detected, but a plurality of other nearby gunshot detection devices have not detected a gunshot, then the likelihood of a gunshot false positive increases. The gunshot false positive business rules and processing logic can identify when to ignore a reported gunshot detection event from other detection devices, even within close proximity to each other. Precedence logic could be implemented to give a higher value to a gunshot event reported in the same room as a gunshot detection device according to the invention.

If a plurality of gunshot detection devices in accordance with the invention are within meaningful proximity report a gunshot event, metadata about decibel level and audio waveform patterns from each device may be used to identify which devices are closer to or more distant from the location of the gun barrel. As previously mentioned, it may be possible to determine if a gunshot detection device is located inside or outside of the same enclosed space as the gun barrel. Audio sound wave patterns are different if the gunshot occurred on the other side of a wall around an enclosed room. Identifying that a preferred gunshot detection device is in the same classroom, hallway, room, or other enclosed space as the gun barrel is of high value to Police and other First Responders who are attempting to determine the location of the active shooter. Seconds can mean the difference between life or death in active shooter situations, so real-time situational awareness has very high value for ending active shooter situations as quickly as possible.

More advanced devices in accordance with the present invention have policy-based processing logic that can automatically start video recording based upon combinations of events. Gunshot detection can be one of these policy-based video recording start events. In many cases a video recording start from any combination of policy-based events causes pre-event video to be pre-pended to the camera's video segment. In the case of a gunshot event, the policy-based recording engine determines whether to pre-pend both video and audio to the camera video being stored and/or transmitted. In addition, a personal camera in accordance with the present invention or data recording device or apps captures GPS, accelerometer, gyroscope, and other metadata that may be embedded in the video file and/or stored once a gunshot has been detected. A gunshot detection device in accordance with the present invention may also generate and transmit gunshot detection sound wave files, metadata, and alerts to remote administrators, local and remote security systems, Incident Command Centers, Police Central Dispatch units, Video Integration Centers, 911 Centers, and other remote systems that could be alerted in the event a gunshot is detected.

In accordance with the invention, gunshot detection metadata and alerts from one or more preferred gunshot detection devices can then be transmitted to real-time situational awareness systems (such as the commercial product known as AVaiLWeb™). The present invention could then make gunshot detection metadata available to First Responder and Resource Officer Dispatch Centers, School Administration workstations, Video Integration Centers, or used in association with web browser map-based views of a facility or area (e.g., a campus or business). Such real-time situational awareness views and alerts may be provided to smartphones, tablets, laptops, computer monitors, Police Computer Aided Dispatch and Video Integration Center monitors, and other web-browser capable display systems.

Further, the present invention includes that gunshot detection metadata and alerts may be transmitted to other gunshot detection devices in local proximity, or all devices within a designated GeoFence boundary. All preferred gunshot detection devices could receive "Be On the Lookout" emergency alert messages with audio alerts, text messages, active shooter photographs, and classroom or office lockdown instructions. A gunshot detection device in accordance with the present invention may provide on-going alerts, status messages, and all-clear messages to teachers, supervisors, or other personnel who have a gunshot detection device.

Similarly, a gunshot detection device in accordance with the present invention may have a messaging capability for device owners to send text messages, photographs, and video clips to central administration, Police Dispatch Centers, Video Integration Centers, and other Incident Command Staff. A preferred gunshot detection device would be able to facilitate real-time situational awareness communications from persons such as teachers, supervisors, and other management personnel that may be somehow involved or affected by an active shooter.

BRIEF DESCRIPTION OF THE DRAWINGS

FIG. 2 is a frequency analysis image that shows a frequency response, even including ultrasonic range (above 20 kHz) of an indoor gunshot computed over a 500 millisecond time span.

FIG. 3 is an image that shows a spectrogram of the same indoor gunshot. Blue indicates low energy, red indicates higher energy, and white indicates highest energy.

FIG. 4 is an image that shows a spectrogram of an indoor loud sound event (specifically, banging two boards together). The gunshot and boards share high energy across the audible spectrum, but the ultrasonic energy for the boards lasts a much shorter time.

DETAILED DESCRIPTION OF THE INVENTION

Figure 1:
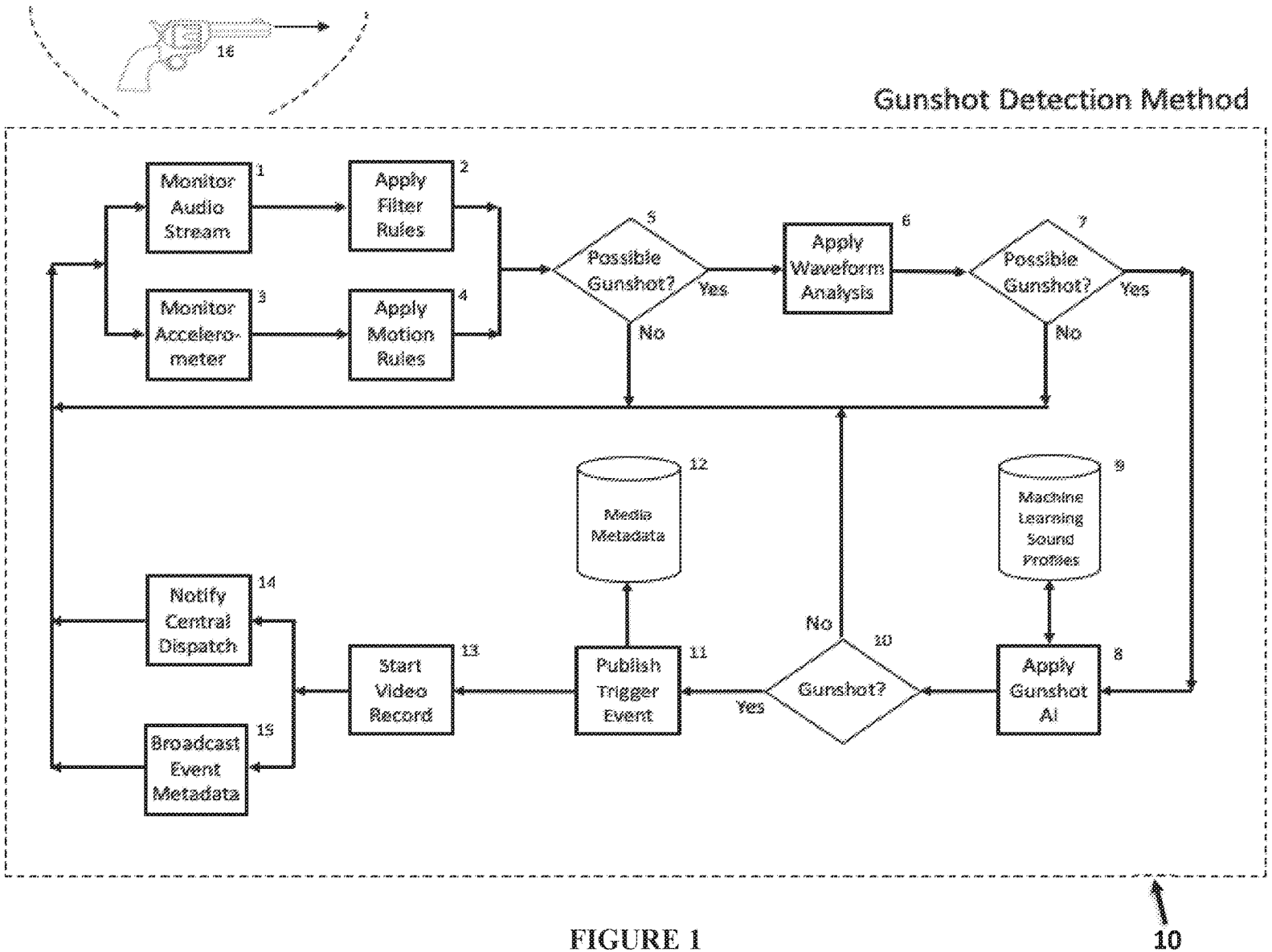
FIG. 1 is a schematic view of a system and method of gunshot detection in accordance with the present invention.

Referring to FIG. 1, a diagrammatic view of the present invention is shown generally at 10, wherein a first preferred stage includes monitoring for audio input that may capture a gunshot event. More specifically, a preferred embodiment includes apparatus that monitors or constantly scans for audio signals that may include the sound of a gunshot event. A first effort is made at this stage to filter our sounds that are decidedly not gunshot events, such as background noise. Higher level filters can be applied to identify possible gunshot like sounds. Thus, ultrasonic sensors, such as microphones, are appropriate for use to provide for "monitoring audio stream" at 1 in FIG. 1, and utilizes a device for converting sound waves into electrical signals (or digital information) that may then be amplified or recorded. A preferred microphone or sensor includes one that is capable of capturing and processing ultrasonic sound. The preferred embodiment may also include a filter that applies rules to isolate possible gunshot sounds. Such rules are known to the person of ordinary skill in art.

It is to be further understood that the apparatus 1 may be placed in various locations, either fixed or mobile. For example, a smartphone may be provided with a microphone that is able to capture gunshot sounds. A smartphone (or other device) may also be provided with an accelerometer that monitors motion and/or orientation of the device. Thus, for example, the accelerometer can monitor the smartphone for motion spikes in any axis (X,Y or Z) that could indicate that the device has hit a hard surface so that the sound associated therewith is not determined to be a gunshot. A preferred embodiment further includes the application of motion filtering rules 4 to identify device falls and hits on hard surfaces that might generate a gunshot-like sound with a high energy level at the microphone. In such a case where the device is mobile or otherwise provided with an accelerometer, both factors are applied 5 to determine if a Spectrogram waveform analysis should be performed (i.e., stage 2).

Figure 2:
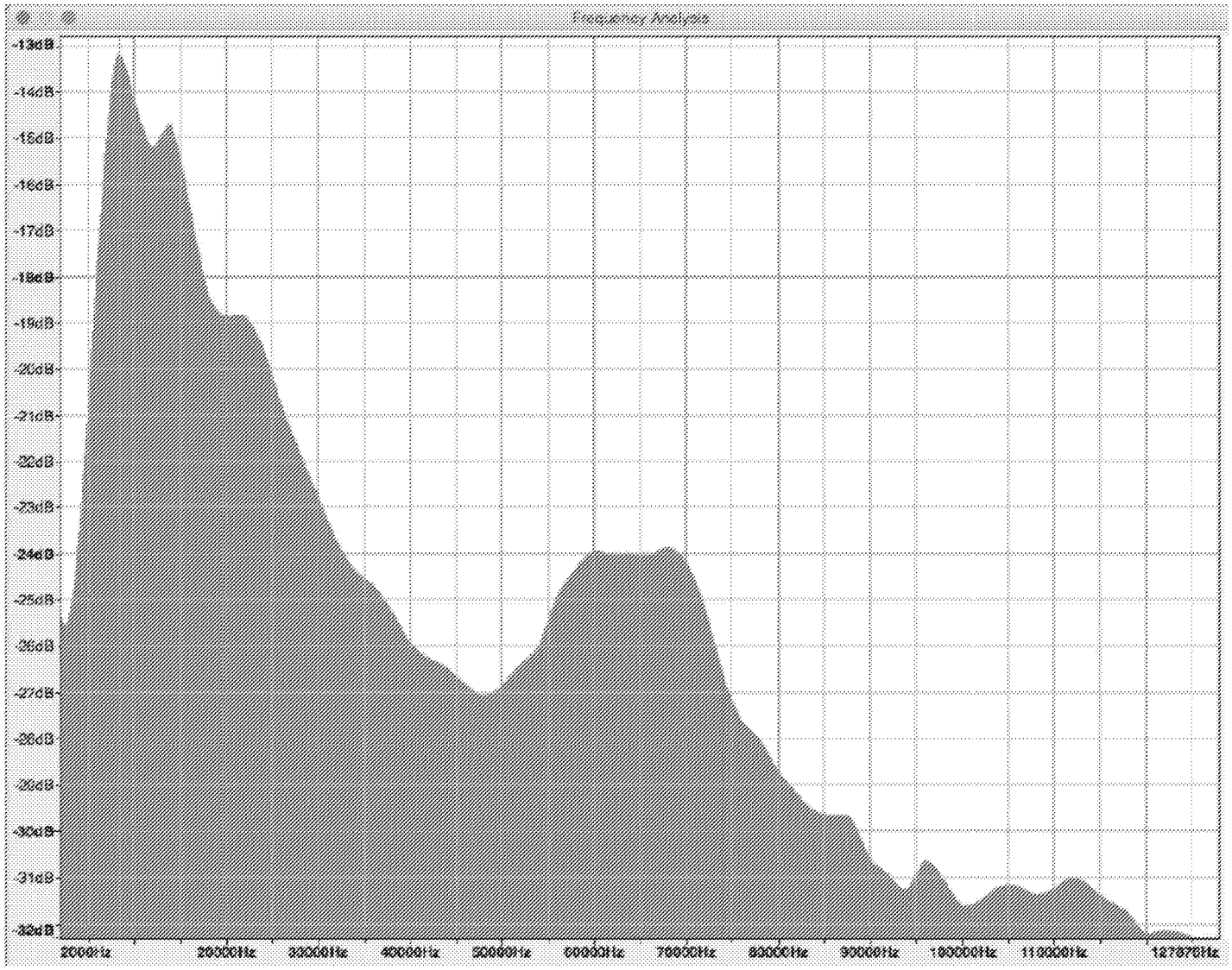
FIGS. 2-4 are, respectively, three spectrograms (44.1 kHz sampling rate, 250 kHz sampling rate, and 384 kHz sampling rate) and described in greater detail below. More particularly.

A second stage of the present invention expressly includes a consideration of ultrasonic sound waves. More particularly, a Spectrogram analysis 6 of the information captured by monitoring the audio stream, is performed. The resulting pattern is evaluated at a high level 7 to determine if a gunshot has been detected. More particularly, the present invention contemplates that a spectrogram of the potential gunshot sound is prepared such as that shown, for example, in FIG. 2. That spectrogram of the potential gunshot sound can be compared to known spectrograms representing the waveforms of the captured known gunshots. That comparison would include a consideration of ultrasonic frequencies. In so doing, the comparison will reveal (by similarity of the captured sound spectrogram to known gunshot spectrograms) whether the captured sound was that of an actual gunshot within a certain reliability range. The comparison includes ultrasonic frequencies of between 20 kHz and 150 kHz. By use of the ultrasonic range, the present invention reduces or minimizes false negatives and false positives.

Figure 3:
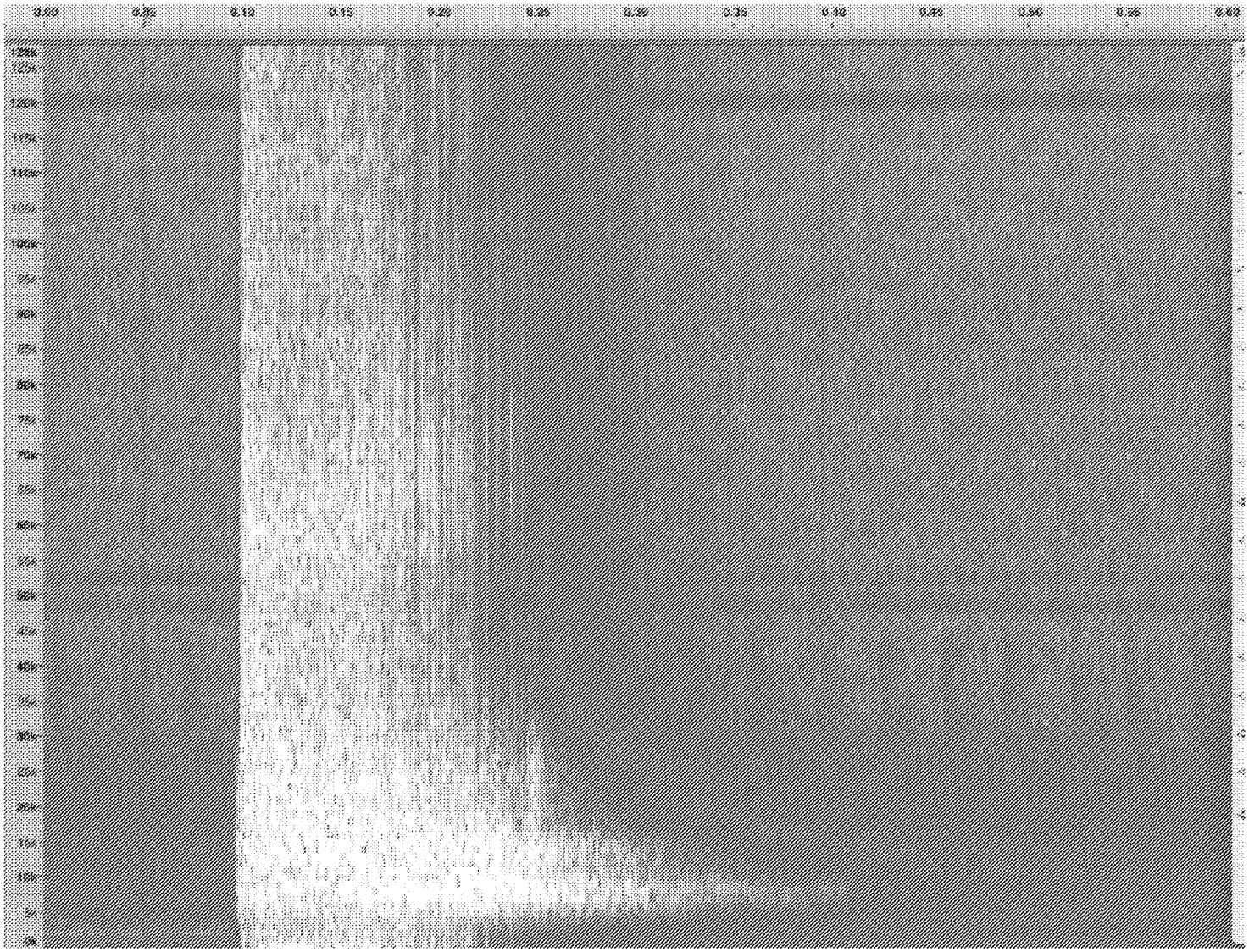
Figure 4:
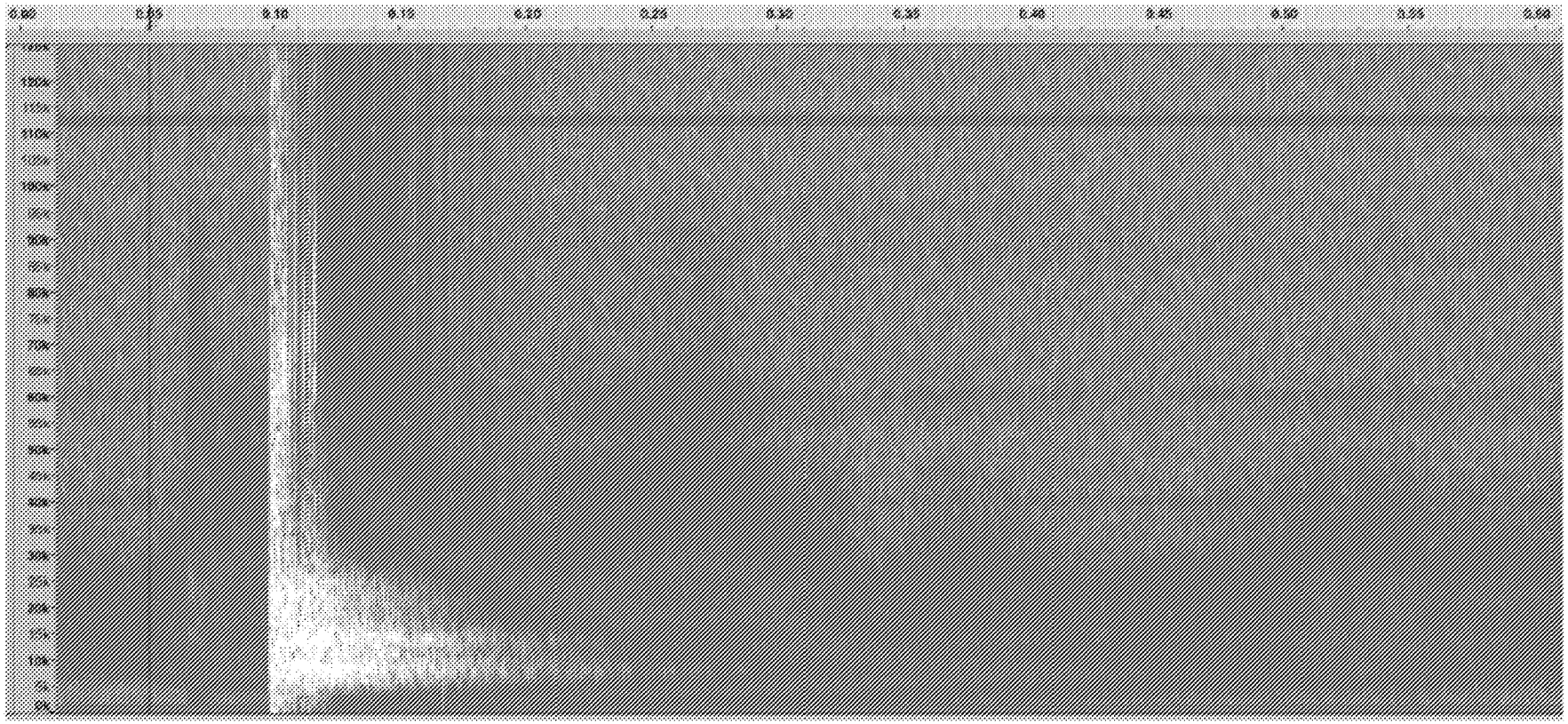

The present invention also utilizes the fact that a gunshot exhibits a high energy response across an entire frequency band, albeit for a brief time, and utilizes spectrograms to look at more than signal intensity and frequency response. Where prior art devices have considered frequency and intensity for a discrete time period (see, for example, the '845 Patent), the present invention considers sonic and ultrasonic frequency response over a greater period of time without averaging across the entire period of time. The spectrogram analysis of the present invention differs from signal energy/intensity analysis of the prior art and thus allows for detection of a gunshot in both open and continued environments. More particularly, the preferred spectrogram of the present invention provides information regarding time (x-axis), frequency (y-axis) and intensity (e.g., high energy; z-axis). As shown in the "Frequency Analysis" image shown in FIG. 3, a frequency response includes ultrasonic range (above 20 kHz) of an indoor gunshot computed over a 500 millisecond time span. This seems to indicate that there is little to no high energy sound in the ultrasonic range, especially in the very high frequency range (EHB—will need to see this "Frequency Analysis", and the next, images to verify that that is what it indicates). The image of FIG. 4 however shows that that high energy is in fact extant, but fleeting. Analyzing the frequency response of a 500 millisecond time window fails to reveal the ultrasonic information unique to a gunshot. FIG. 4 shows a spectrogram of the same indoor gunshot (blue indicates low energy, red indicates higher energy, and white indicates highest energy). FIG. 4 thus shows the characteristic of a gunshot, namely, high energy in the ultrasonic frequency range for a somewhat extended period of time (around 100 milliseconds from 0.10 to 0.20). FIG. 5 shows a spectrogram of an indoor loud sound event (specifically, banging two boards together). The gunshot and boards share high energy across the audible spectrum, but the ultrasonic energy for the boards lasts a much shorter time.

The present invention further includes looking at a larger time period than that known to exist in the prior art. Thus, by virtue of the spectrogram, the present invention considers high energy (i.e., loud) sounds of more intensity than the prior art, and further considers such factors for a greater length of time and in smaller increments than that previously accomplished in the prior art, at both sonic and ultrasonic levels. Thus, for example, where a prior art detection method may have considered results over 250 or 500 milliseconds, the present invention addresses time increments in as little as 100 milliseconds (0.1 sec) and considers the spectrogram information (time, frequency, intensity) for substantially the entire length of the captured gunshot sound—as much as a full second or more. Thus, under the present invention, key distinguishing energy readings are found in the first 100 milliseconds, but not averaged into a larger time period (such as 200 milliseconds) where the results would be averaged out and potentially missed.

If the above-described spectrogram comparison of the captured gunshot to a known gunshot spectrogram reveals an actual gunshot, that information my be relayed to third parties such as law enforcement, first responders, etc. Further, that information is preferably captured, and the spectrogram and sound profile is transferred to an AI engine 9, where the profile is added to the stored profiles, thus allowing for further comparison and further reduction or minimization of "false positives" and "false negatives."

To the extent possible, further metadata such as distance from the microphone and gun type and caliber 10 are determined by Spectrogram Signature Pattern Analysis and Correlation, Pixel Array Histogram Correlation, AI Model edge processing, or other means. Once a gunshot event 10 is confirmed, gunshot metadata is published 11 to a metadata repository 12 for audit trail and chain of custody reporting. In the case of a BodyWorn camera, Video Recording 13 is started. Gunshot detection event notifications 14 are sent to Central Dispatch and any other predetermined authorized metadata recipients. To the extent possible, video, audio, and metadata is lived streamed to authorized recipients.

The Gunshot Detection closed loop process continues while the Gunshot Detection device is operational.

ADVANTAGES OF THE PRESENT INVENTION

The present invention will increase active-shooter real-time situational awareness both outside and inside buildings, while minimizing the negative effects of Gunshot Detection False Positives and False Negatives. Real-time edge processing and correlation of metadata from multiple sensors can correctly identify gunshot events that audio only gunshot energy or triangulation analysis would miss.

Information rich Spectrogram result signature patterns can uniquely identify metadata beyond whether a gunshot occurred. The signature pattern can further identify gun type, caliber, and distance and angle from the gun barrel.

The present invention provides highly accurate real-time situational awareness reporting from inside schools, offices, shopping malls, and other inside locations where legacy outside sound triangulation systems can't. At the same time, the Spectrogram analysis provides a high degree of gunshot recognition capability outside in clear air. In both cases First Responders are able to respond faster and more effectively to an active shooter event.

"Crowdsourcing" gunshot sensor data from multiple devices located in a school, church, synagogue, campus and other locations further increases the range and accuracy of real-time situational awareness reporting. The risk of "Friendly Fire" tragedies can be reduced, and situations can conclude sooner.

Having thus described exemplary embodiments of the present invention, those skilled in the art will appreciate that the within disclosures are exemplary only and that various other alternatives, adaptations, and modifications may be made within the scope of the present invention. Accordingly, the present invention is not limited to the specific embodiments as illustrated herein, but is only limited by the following claims.

What is claimed:

1. A system for detecting a gunshot comprising:

a device for capturing acoustic data that is potentially sound emanating from an actual gunshot;

circuitry configured to receive electrical signals and to generate digital signals comprising digital data which corresponds to the received acoustic data;

a processor including non-transitory, computer-readable medium comprising computer-executable instructions for determining whether the captured acoustic data or sampled portions of the captured acoustic data contains an ultrasonic burst that corresponds to an ultrasonic signature of an actual gunshot having contiguous ultrasonic component sound frequency content in excess of 20 kHz, whereby the determination is used to identify an actual gunshot and distinguish it from that of a sound burst that is not an actual gunshot.

2. The system of claim 1, wherein the device captures the acoustic data at a sampling rate that is at least twice the highest discrete ultrasonic frequency sought to be captured.

3. The system of claim 1, wherein the circuitry generates the digital signals by calculating a Fast Fourier Transformation (FFT) in accordance with any known FFT algorithm.

4. The system of claim 1, wherein the circuitry generates the digital signals by calculating a Fast Fourier Transformation (FFT) in accordance with known FFT implementation.

5. The system of claim 1, wherein the circuitry generates the digital signals by creating a spectrogram having a spectrum of frequencies of the signal as it varies with time, and further detects an impulse prior to generating the digital signals that yields the spectrogram.

6. The system of claim 1, wherein the computer-executable instructions further cause the system to transmit the captured acoustic data to a second location for storage or further processing.

7. The system of claim 1, wherein the circuitry generates the digital signals by creating a spectrogram having a spectrum of frequencies of the signal as it varies with time, and the computer-executable instructions further cause the system to transmit the spectrogram to a second location for storage or further processing.

8. The system of claim 1, wherein the circuitry generates the digital signals by creating a spectrum of frequencies over a short period of time, and the computer-executable instructions further cause the system to transmit the spectrum to a second location for storage or further processing.

9. The system of claim 1, wherein the computer-executable instructions further cause the system to transmit the captured acoustic data to a second location prior to the circuitry generating the digital signals that yields the spectrogram.

10. The system of claim 1, wherein, responsive to a gunshot determination, the computer-executable instructions further cause the system to record at least one of a date and time of occurrence of the determination.

11. A method for detecting a gunshot, comprising:

providing a device for capturing acoustic data that is potentially sound emanating from an actual gunshot;

providing circuitry configured to receive electrical signals and to generate digital signals comprising digital data which corresponds to the received acoustic data;

determining whether the captured acoustic data or sampled portions of the captured acoustic data contains an ultrasonic burst that corresponds to an ultrasonic signature of an actual gunshot having contiguous ultrasonic component sound frequency content in excess of 20 kHz, whereby the determination is used to identify an actual gunshot and distinguish it from that of a sound burst that is not an actual gunshot.

12. The method of claim 11, wherein the device captures the acoustic data at a sampling rate that is at least twice the highest discrete ultrasonic frequency sought to be captured.

13. The method of claim 11, wherein the circuitry generates the digital signals by calculating a Fast Fourier Transformation (FFT) in accordance with any known FFT algorithm.

14. The method of claim 11, wherein the circuitry generates the digital signals by calculating a Fast Fourier Transformation (FFT) in accordance with known FFT implementation.

15. The method of claim 11, wherein the circuitry generates the digital signals by creating a spectrogram having a spectrum of frequencies of the signal as it varies with time, and further detects an impulse prior to generating the digital signals that yields the spectrogram.

16. The method of claim 11, further comprising transmitting the captured acoustic data to a second location for storage or further processing.

17. The method of claim 11, wherein the circuitry generates the digital signals by creating a spectrogram having a spectrum of frequencies of the signal as it varies with time, and the method further comprises transmitting the spectrogram to a second location for storage or further processing.

18. The method of claim 11, wherein the circuitry generates the digital signals by creating a spectrum of frequencies over a short period of time, and the method further comprises transmitting the spectrum to a second location for storage or further processing.

19. The method of claim 11, further comprising transmitting the captured acoustic data to a second location prior to the circuitry generating the digital signals that yields the spectrogram.

20. The method of claim 11, further comprising, responsive to a gunshot determination, recording at least one of a date and time of occurrence of the determination.

* * * * *